US007367159B2

(12) United States Patent
Delgado et al.

(10) Patent No.: US 7,367,159 B2
(45) Date of Patent: May 6, 2008

(54) DUAL OVERHEAD TRACK FOR A SLIDING DOOR

(75) Inventors: Joe Delgado, West Bend, WI (US); Arno Klein, Nordstemmen (DE); Louis B. Mueller, Richfield, WI (US); Mark Semmann, Cedarburg, WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 10/654,132

(22) Filed: Sep. 3, 2003

(65) Prior Publication Data

US 2004/0083653 A1 May 6, 2004

Related U.S. Application Data

(60) Provisional application No. 60/407,889, filed on Sep. 3, 2002.

(51) Int. Cl.
*E05F 11/54* (2006.01)

(52) U.S. Cl. ..... 49/120; 49/116; 49/366; 49/370; 49/409; 49/231

(58) Field of Classification Search ..... 49/404, 49/409, 410, 226, 228, 231, 118, 370, 116, 49/120, 209, 366, 367; 16/96 R, 87 R, 94 R
See application file for complete search history.

(56) References Cited

U.S. PATENT DOCUMENTS 371,419 A * 10/1887 Brownell ..... 16/97
880,865 A * 3/1908 Davis ..... 49/412
915,386 A * 3/1909 Schuler ..... 16/96 R
1,294,589 A 2/1919 Wolfe
1,411,039 A * 3/1922 Lacey ..... 49/118
1,592,138 A 7/1926 Gilpin
2,094,932 A 10/1937 Swan
2,361,882 A * 10/1944 Smith ..... 16/96 R
2,878,532 A 3/1959 Clark (Continued)

FOREIGN PATENT DOCUMENTS

DE 197 25 355 A 1 12/1998

(Continued)

OTHER PUBLICATIONS

International Search Report mailed Jan. 20, 2004 for PCT Application No. PCT/US03/27666, filed Feb. 9, 2003.

*Primary Examiner*—Gregory J. Strimbu
(74) *Attorney, Agent, or Firm*—Factor & Lake, Ltd.

(57) ABSTRACT

A sliding door for selectively opening and closing an opening. The door comprises a first guide track defining a first linear guide path and a second guide track defining a second linear guide path. The second guide track is spaced from the first guide track. The door further comprises a door panel having a top edge, a bottom edge, a leading edge and a trailing edge. The door panel is adapted to translate laterally relative to the opening between a closed position and an open position. A first portion of the door panel is attached to the first guide track and a second portion of the door panel is attached to the second guide track. The door moves vertically as the door is translated from the open position to the closed position as rollers engage recesses positioned on the first and second guide tracks.

17 Claims, 9 Drawing Sheets

U.S. PATENT DOCUMENTS

| | | | | | |
|---|---|---|---|---|---|
| 2,922,183 | A | | 1/1960 | Taylor | |
| 3,098,519 | A | | 7/1963 | Myers et al. | |
| 3,276,166 | A | * | 10/1966 | Markus | 49/410 |
| 3,318,048 | A | * | 5/1967 | Odend Hall | 49/223 |
| 3,460,602 | A | | 8/1969 | Hugus | |
| 3,611,637 | A | * | 10/1971 | Saino | 49/235 |
| 3,834,081 | A | | 9/1974 | Catlett | |
| 4,064,924 | A | | 12/1977 | Catlett | |
| 4,402,159 | A | | 9/1983 | Domagalski | |
| 4,404,770 | A | * | 9/1983 | Markus | 49/235 |
| 4,452,014 | A | * | 6/1984 | Markus | 49/360 |
| 4,476,652 | A | | 10/1984 | Beauchot | |
| 4,503,637 | A | | 3/1985 | Parente | |
| 4,503,638 | A | | 3/1985 | Schindehutte | |
| 4,619,075 | A | | 10/1986 | Wiles | |
| 4,651,469 | A | | 3/1987 | Ngian et al. | |
| 4,680,828 | A | | 7/1987 | Cook et al. | |
| 4,754,573 | A | * | 7/1988 | van Rooij et al. | 49/370 |
| 4,770,224 | A | | 9/1988 | Dubbelman | |
| 4,852,628 | A | | 8/1989 | Klein | |
| 4,881,346 | A | * | 11/1989 | Block | 49/501 |
| 4,887,659 | A | | 12/1989 | West | |
| 4,901,474 | A | | 2/1990 | Bayard et al. | |
| 4,950,869 | A | | 8/1990 | Mueller | |
| 5,127,190 | A | | 7/1992 | Hein et al. | |
| 5,148,631 | A | | 9/1992 | Bayard et al. | |
| 5,165,142 | A | * | 11/1992 | Pilsbury | 16/90 |
| 5,247,763 | A | | 9/1993 | Hein | |
| 5,253,452 | A | | 10/1993 | Goldbach | |
| 5,335,710 | A | | 8/1994 | Belanger | |
| 5,347,755 | A | | 9/1994 | Jaster et al. | |
| 5,381,846 | A | | 1/1995 | Lichy | |
| 5,422,552 | A | | 6/1995 | Parisi | |
| 5,456,303 | A | | 10/1995 | Horinouchi | |
| 5,461,829 | A | * | 10/1995 | Lehto et al. | 49/409 |
| 5,477,902 | A | | 12/1995 | Kraeutler | |
| 5,701,973 | A | | 12/1997 | Tracey | |
| 5,907,890 | A | | 6/1999 | Redaelli | |
| 6,098,341 | A | * | 8/2000 | Gebauer | 49/226 |
| 6,115,968 | A | * | 9/2000 | Sarlanis | 49/409 |
| 6,330,763 | B1 | | 12/2001 | Kern et al. | |
| 6,336,248 | B1 | | 1/2002 | Finkelstein et al. | |
| 6,945,364 | B1 | * | 9/2005 | Wesson et al. | 187/334 |
| 2002/0017060 | A1 | | 2/2002 | Kern et al. | |

FOREIGN PATENT DOCUMENTS

| | | |
|---|---|---|
| EP | 1 203 863 A1 | 8/2002 |
| SE | 446 114 | 3/1968 |
| WO | WO 01/18469 A1 | 3/2001 |

* cited by examiner

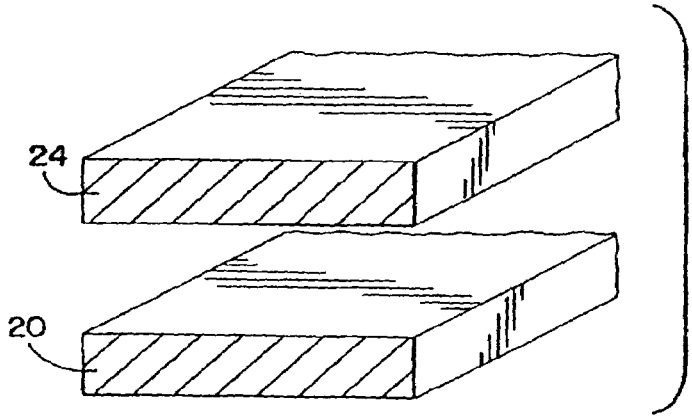
FIG. 5A
FIG. 5B
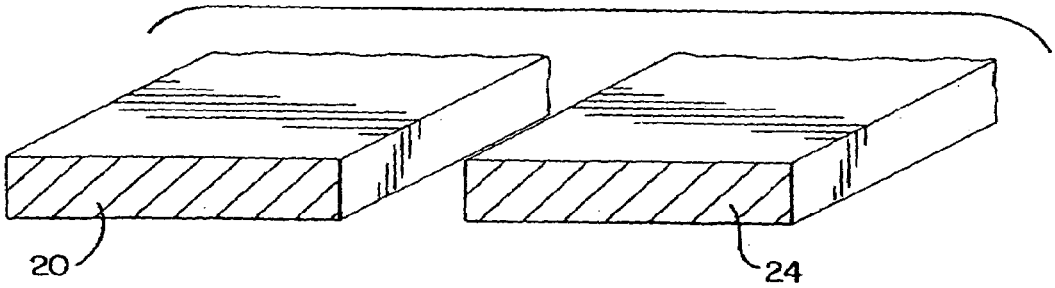
FIG. 5C
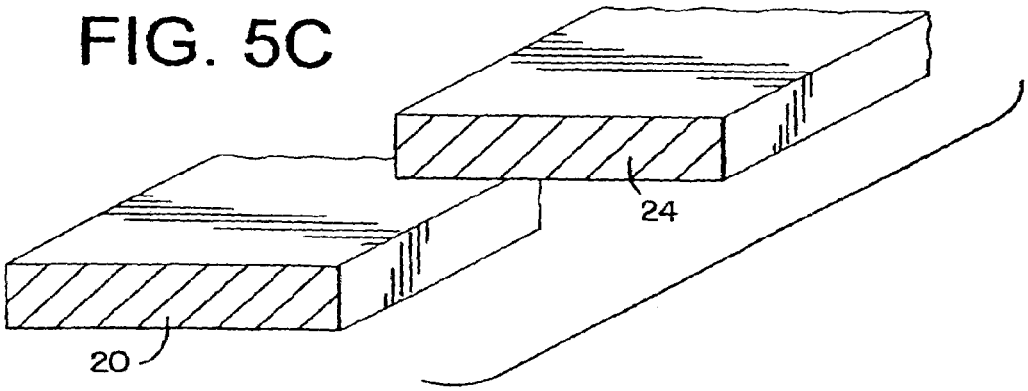

DUAL OVERHEAD TRACK FOR A SLIDING DOOR

RELATED APPLICATION

This application claims the benefit of U.S. Provisional Patent Application Ser. No. 60/407,889, entitled "Dual Overhead Track For a Sliding Door," filed Sep. 3, 2002. This application is incorporated herein by reference.

TECHNICAL FIELD

The invention relates to an overhead track for industrial doors, and more particularly to a dual overhead track system for high-speed, sliding industrial doors.

BACKGROUND OF THE INVENTION

Sliding doors have been used for many years to secure various enclosures, including those for cold storage facilities in manufacturing plants, warehouses, garages, and other industrial rooms.

Others have developed track systems and drive systems which operate together to open and close single panel and multi-panel sliding doors. For example, U.S. Pat. No. 1,054,376 to Weidrich discloses a sliding door hanger and track. In Weidrich a rotating wheel, similar to a pulley, rides along a track with the door being suspended from the axle of the wheel. The door can be slid manually along the track from an opened to a closed position, and vice versa. Subsequent to Weidrich, U.S. Pat. No. 4,344,206 to Hermanson discloses a channel track system which supports a sliding door from the axle of two transversely mounted wheels. Other examples of this "track and wheel" configuration are shown in U.S. Pat. Nos. 4,619,075 to Wiles; 4,651,469 to Ngian et al; 4,680,828 to Cook et al.; 4,770,224 to Dubbelman; and 4,819,743 to Rousselot et al.

An area which has not received much attention in this field is the ability to preserve the seals on the door panel during actuation of such doors. In the use of bi-parting doors, either sliding or folding, the bottom seal of such doors often slide along the bottom of the doorway during operation. Such sliding often results in frictional abrasion and wear on the bottom seal of the door. Such wear can often result in heat loss, cold loss. The sliding operation may also increase and wear on other parts of the door assembly as a result of vibrational noise. Such wear on the bottom seal and the door assembly generally can also result in extended down time and increased replacement costs.

Systems such as those disclosed in U.S. Pat. No. 6,330,763 to Kern et al. have been developed in an attempt to address some of the issues described above. However, there still exists limitations inherent to such systems. For example, the system described in U.S. Pat. No. 6,330,763 utilizes angled track and attempts to reduce wear on the lower seal by tilting the panels away from the floor as the door moves toward the closed position or as it just begins to open. The system disclosed in U.S. Pat. No. 6,330,763, however, has some inherent drawbacks. For example, the use of an angled track may cause tumultuous movement of the door as it moves toward its closed position and one portion of the door panel makes contact with the bottom of the opening before the trailing edge comes to rest on the bottom surface. This unsynchronized contact may cause damage, not only to the door seals, but also to the other components of the door assembly. Moreover, the system described in U.S. Pat. No. 6,330,763 increases the possibility of creating an uneven or deficient seal between the door panel bottom and the bottom of the opening.

The present invention has achieved a more reliable, more durable, and more cost effective system for opening and closing sliding doors, such as those used for warehouses, cold storage, freezers, and the like. Thus, while the systems discussed above have been met with a reasonable degree of success, the present invention is provided to solve the problems discussed above and other problems, and to provide advantages and aspects not provided by prior doors of this type.

SUMMARY OF THE INVENTION

The present invention provides a sliding door for selectively opening and closing an opening. The door comprises a first guide track defining a first linear guide path and a second guide track defining a second linear guide path. The second guide track is spaced from the first guide track. the door further comprises a door panel having a top edge, a bottom edge, a leading edge and a trailing edge. The door panel is adapted to translate laterally relative to the opening between a closed position and an open position. A first portion of the door panel is attached to the first guide track and a second portion of the door panel is attached to the second guide track.

According to another aspect of the present invention, the above-described door further comprising a first recess defined in the first guide track and a second recess defined in the second guide track. The second recess is linearly spaced from the first recess. The door panel is attached to the guide tracks by a first trolley and second trolley. Each of the trolleys comprise a first and second roller mount. Each of the roller mounts have at least one roller attached thereto for operably engaging one of respective first and second guide tracks. The first and second trolleys assist the door panel to translate laterally between the open and closed positions. The trolleys also assist the rollers of the respective roller mounts to substantially contemporaneously engage in the recesses in the respective guide tracks, thereby causing the door panel to move toward the bottom of the opening.

According to yet another aspect of the present invention, a bi-parting sliding door is provided. The bi-parting sliding door comprises a first guide track defining a first linear guide path. The first guide track is mounted proximate the top of the opening and includes a first recess and a second recess defined therein. The first and second recesses are linearly spaced on opposed sides of a midpoint of the first guide track. The bi-parting sliding door also has a second guide track defining a second linear guide path. The second guide track is mounted proximate the top of the opening and is spaced from the first guide track. The second guide track also includes a first recess and a second recess defined therein. The first and second recesses in the second track are linearly spaced from the midpoint of the first guide track and at an outward distance from first and second recesses of the first guide track. The bi-parting sliding door further comprises a first door panel and a second door panel each having a top edge, a bottom edge, a leading edge and a trailing edge. The first and second door panel are each adapted to translate laterally relative to the opening between a closed position and an open position. A first portion of each of the door panels is attached to the first guide track and a second portion of each of the door panels is attached to the second guide track.

These and other advantages will be made apparent from the following description of the drawings and detailed description of the invention.

BRIEF DESCRIPTION OF THE DRAWINGS

FIG. 5A is a schematic end view of an embodiment of guide tracks positioning that may be used in connection with the door assembly of the present invention;

FIG. 5B is a schematic end view of a second embodiment of guide tracks positioning that may be used in connection with the door assembly of the present invention;

FIG. 5C is a schematic end view of a third embodiment of guide tracks positioning that may be used in connection with the door assembly of the present invention;

DETAILED DESCRIPTION

Figure 1:
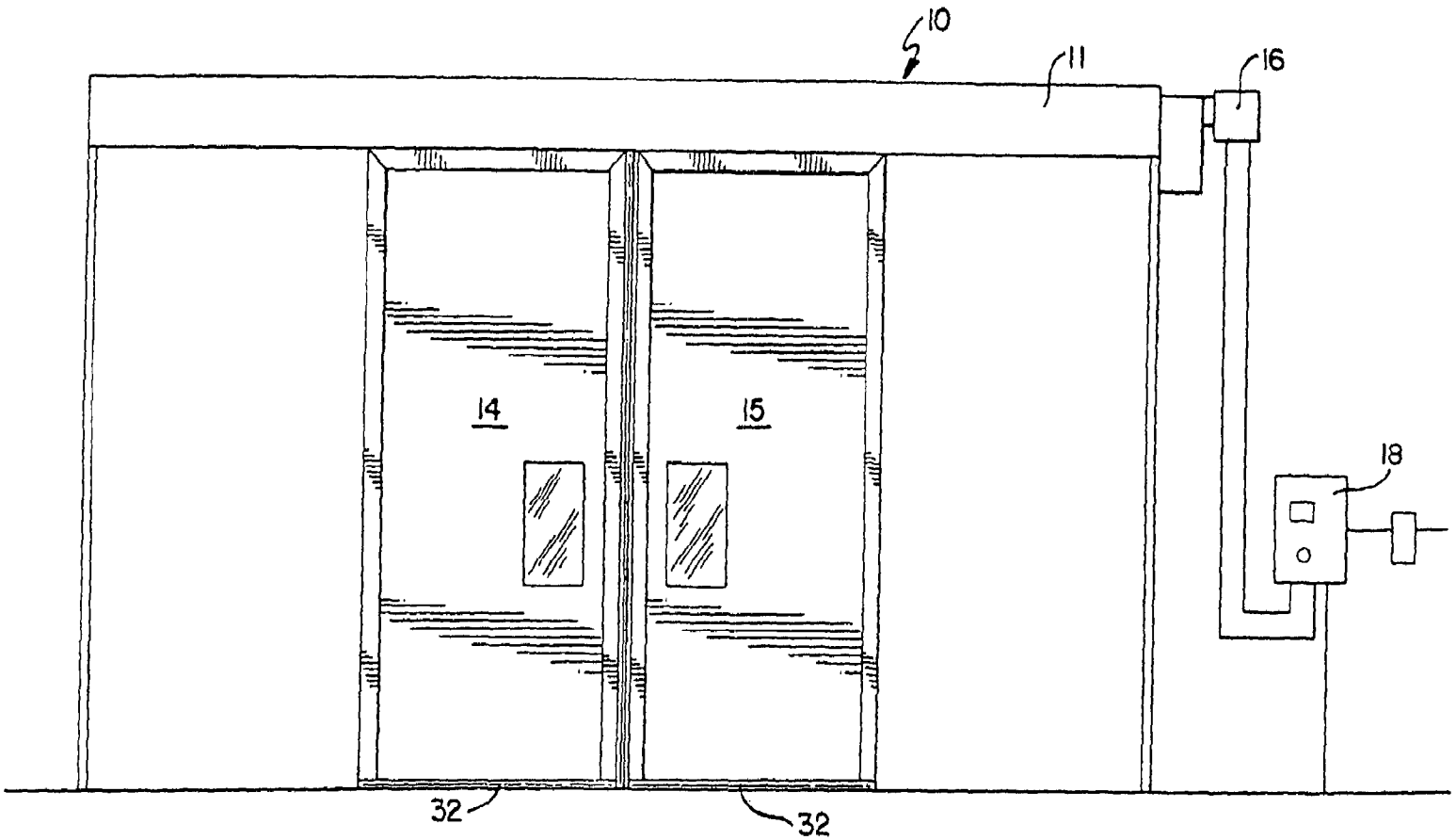
FIG. 1 is a front view of a bi-parting door assembly according to the present invention.

While this invention is susceptible to embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

The present invention is directed a sliding door system, and in particular, to an overhead track for such a door system. FIG. 1 shows an automatic bi-parting sliding door system of the present invention, generally designated with the reference numeral 10, installed about an opening. "Opening" generally refers to any passage or through-way defined in a general manner by a top, a bottom and one or more wall edges or other frame-like structures. The door system 10 described herein provides several advantages over prior art systems. For example, the present invention may be employed to protect the bottom edge of sliding door panel, or seals used in connection therewith, from wear caused by the lateral translation of the doors during opening and closing in operation.

Generally, the present invention includes a overhead track system 12, at least one door panel 14,15, and a motor 16 operably coupled to a drive system for actuating the door panel 14,15 between the open and closed positions. A header compartment 11 may be used to house the overhead track system 12. For example, the present invention may utilize drive motor 16 of the type manufactured by SEW-Eurodrive and marketed under the trade name a SEW-Eurodrive MOV-IMOT®. However, the present door system 10 may employ any drive motor 16 that is capable of, at least, bidirectional, two-speed operation. The door system 10 of the present invention may also include a controller 18 that is in electronic communication with the motor 16. The controller 18 may be any type suitable for use with door assemblies, and which are adapted to control the starting, stopping, speed and direction of the motor 16. It is contemplated, however, that the present invention be employed in an application wherein the door panel is manually moved between the opened and closed positions.

Figure 2:
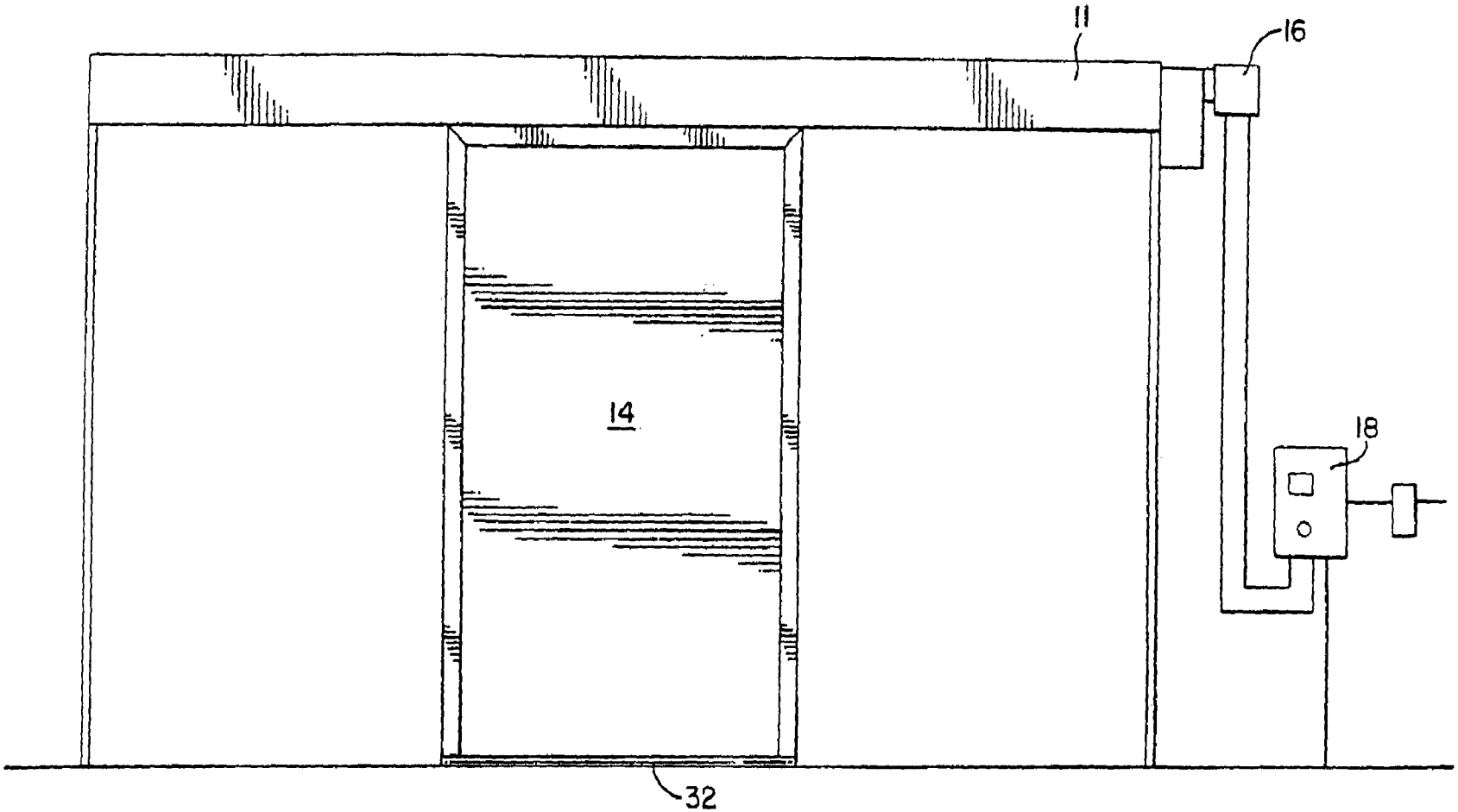
FIG. 2 is a front view of a single sliding door assembly according to the present invention.

As seen in FIGS. 1 and 2, the present invention further includes at least one door panel 14,15. Each door panel 14,15 should be approximately equal to one-half the width of the opening, and of a height approximately equal to the opening height. With a single sliding door (FIG. 2), the door panel 14 is preferably of the same approximate height and width of the opening. However, where certain applications may require, it is contemplated by the present invention that the cumulative size of all door panels in a single application could be significantly less than, or significantly more than the size of the opening. Furthermore, the use of greater than two door panels (not shown) is also contemplated, and the modification of the presently disclosed invention to accommodate such design variations would naturally be readily understood by those skilled in the art after studying this disclosure, without requiring undue experimentation. All remaining discussions will be directed to a bi-parting sliding door design, but it is understood that such discussion will also be applicable to single or multi-panel sliding doors and the particular design variations mentioned. These types of doors are well known in the art and application of the following discussion to such doors will be readily understood by those skilled in the art.

As shown in FIG. 1, the present invention includes first and second door panels 14, 15. Each door panel 14,15 has a leading edge and a trailing edge and is adapted to laterally translate one toward the other along a plane relative to the opening between an open position and a closed position. According to the present invention, the door panels 14,15 have a substantially linear opening and closing direction of travel. However, it is contemplated that the travel of the door panels 14,15 between the open and closed positions may be slightly non-linear to compensate for seals on the leading edge or the door, or for other reasons deemed necessary for operation of the bi-parting door. In one embodiment of the present invention, the door panels 14,15 further include a bottom seal disposed proximate the bottom edge of the first and second door panels 14,15 the door panels may be designed in a variety of sizes from any number of materials, depending on the application.

Referring still to FIG. 1, the header compartment 11 can be more readily understood. In one embodiment of the present invention, the header compartment 11 is centered above the door opening and is used for concealing and protecting the mounting of various components of the door system 10. It is preferable that header compartment 11 span at least approximately twice the width of the opening to allow each door panel 14 to clear the opening when retracted. In this embodiment, approximately one-quarter of the length of header compartment 11 will extend beyond each side of the opening. For aesthetics and protection of the various components, the header compartment 11 may be completely enclosed by a metal or plastic housing, if desired. Additionally, if space allows, header compartment 11 may be recessed within the wall containing the opening.

Figure 3:
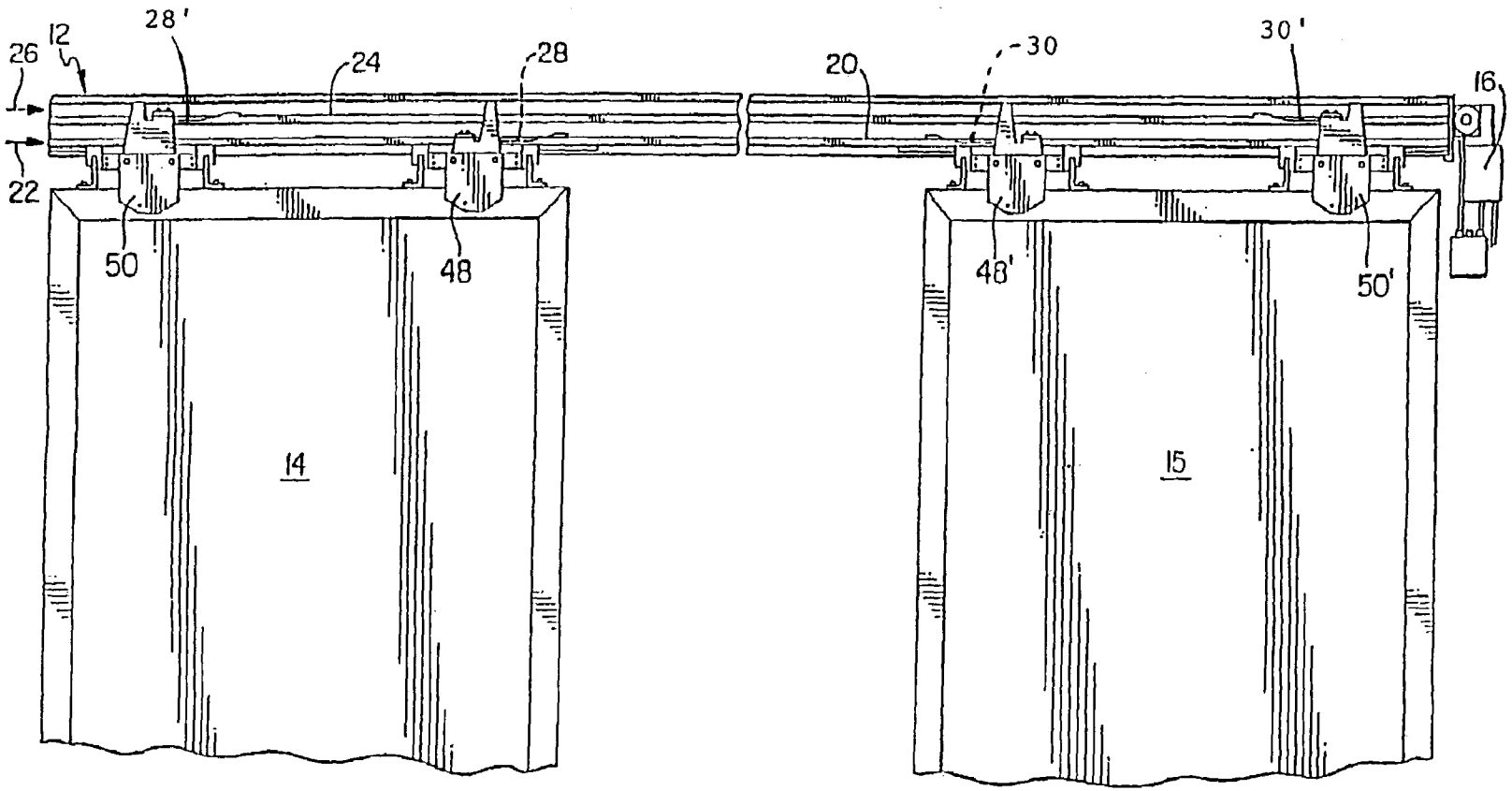
FIG. 3 is a front view of a guide track and trolley assembly according to the present invention.

As discussed above, the overhead track system 12 of the present invention may be concealed within the header compartment 11. As seen in FIG. 3, the overhead track system 12 of the present invention generally comprises a first guide track 20 defining a first linear guide path 22 and a second guide track 24 defining a second linear path 26. The first guide track 20 is mounted proximate the top of the opening and includes a first recess 28 and a second recess 30 defined therein. The first and second recesses 28,30 are linearly spaced on opposed sides of a midpoint of the first guide track 20. The second guide track 24 is mounted proximate the top of the opening and spaced from the first guide track 20. The second guide track 24 also includes a first recess 28 and a second recess 30 defined therein. The first and second recesses 28,30 in the second track 24 are linearly spaced from the midpoint of the first guide track 20, and are outwardly spaced at a distance from first and second recesses 28,30 of the first guide track 20.

Figure 4A:
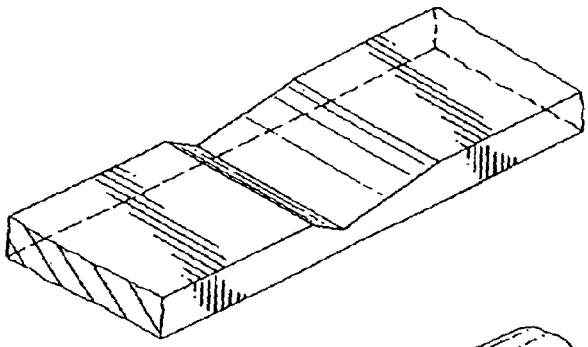
FIG. 4A is a perspective view of one embodiment of a guide track that may be used in connection with the door assembly of the present invention.
Figure 4B:
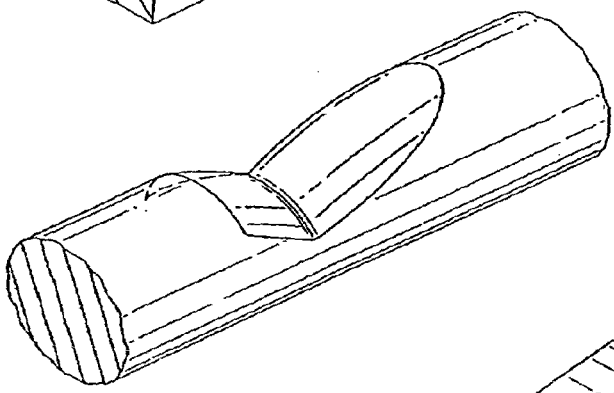
FIG. 4B is a perspective view of a second embodiment of a guide track that may be used in connection with the door assembly of the present invention.
Figure 4C:
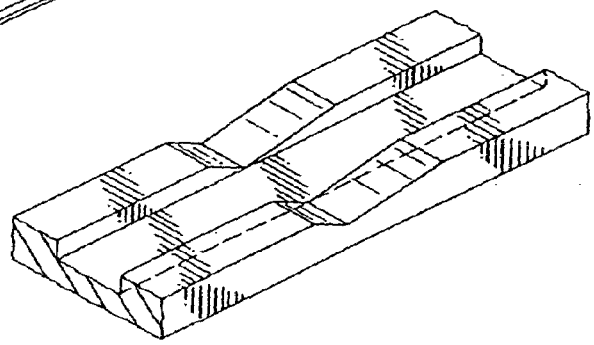
FIG. 4C is a perspective view of a third embodiment of a guide track that may be used in connection with the door assembly of the present invention.
Figure 4D:
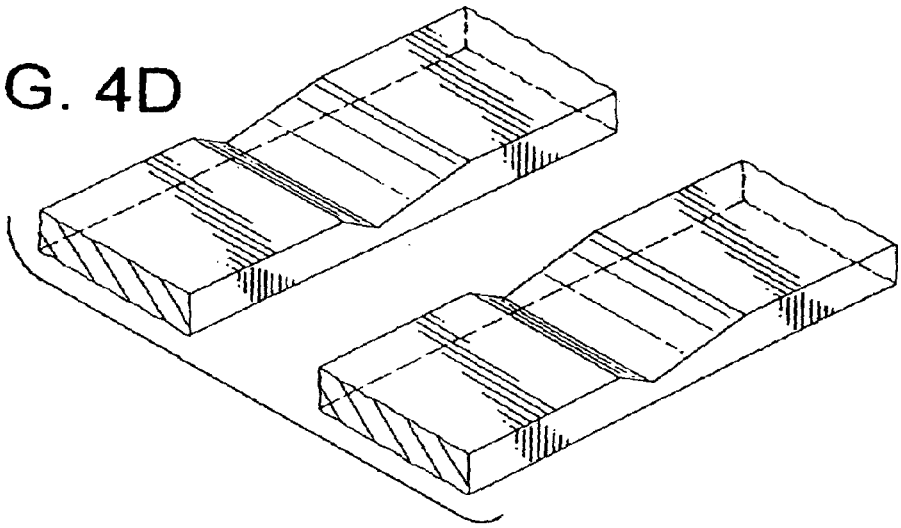
FIG. 4D is a perspective view of a fourth embodiment of a guide track that may be used in connection with the door assembly of the present invention.
Figure 6:
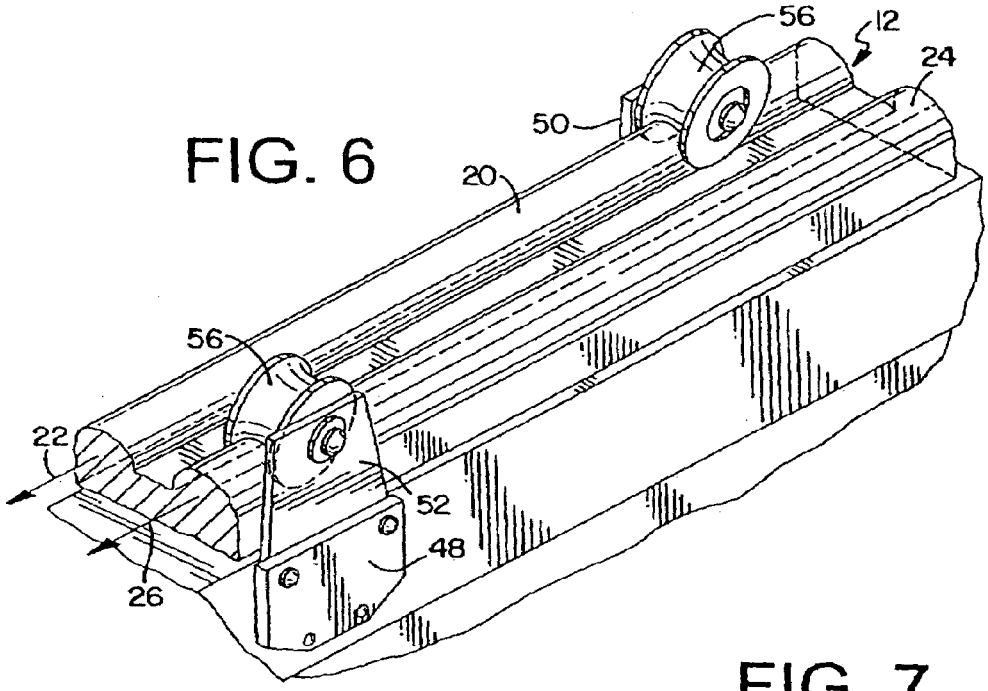
FIG. 6 is a perspective view of another embodiment of a guide track and trolley assembly according to the present invention.

The first and second guide tracks 20, 24 may be any surface suitable to accommodate linear movement of at least a portion of a door panels 14,15. Several embodiments of suitable linear surfaces are illustrated in FIGS. 4A-4D. It should be noted, however, that the present invention should not be limited to those illustrated in FIGS. 4A-4D. Accordingly, the first and second guide tracks 20,24 may be plates, rods, bars, u-shaped tracks, v-shaped tracks, c-shaped tracks, or any other surface suitable for providing a generally linear surface. It is also contemplated by the present invention that the first and second guide tracks 20,24 are defined by a pair of parallel linear surfaces as shown in FIG. 4D. It is further contemplated by the present invention that the first and second guide tracks 20,24 are each canted downward toward an apex formed proximate the midpoint of the opening.

With respect to the positioning of the guide tracks 20,24 relative to one another, it is contemplated by the present invention that the guide tracks be positioned in any configuration which provides first and second linear guide paths 22,26 which are spaced apart. Some contemplated embodiments are depicted in FIGS. 5A-5C. For example, in one embodiment of the present invention, the first guide track 20 is disposed directly above the second guide track 24. According to another embodiment illustrated in FIG. 5B, the first and second guide tracks 20,24 are generally disposed side-by-side such that the guide tracks 20,24 are spaced the same distance from the bottom of the opening. According to yet another embodiment depicted in FIG. 6, the first and second guide tracks 20,24 are formed from a single piece of material, but clearly define a first linear said path 22 and second linear guide path 26, wherein the first and second linear guide paths 22,26 are spaced apart. FIGS. 5A-C and 6 illustrate several embodiments of guide track positioning. However, it should be reasonably understood that the present invention should not be limited to those embodiments shown in FIGS. 5A-C and 6. Instead, any configuration that provides a pair of spaced linear guide paths may be employed without departing from the present invention.

Figure 7:
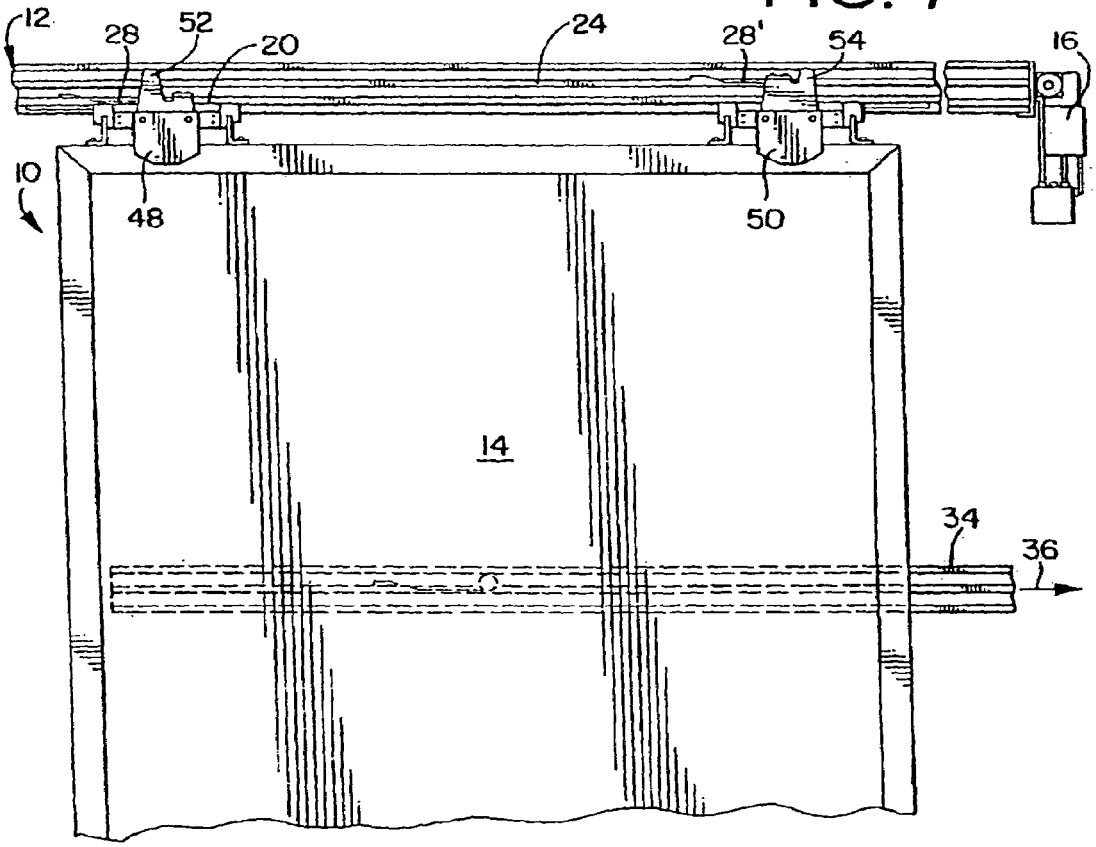
FIG. 7 is a front view of another embodiment of the door assembly according to the present invention.
Figure 8A:
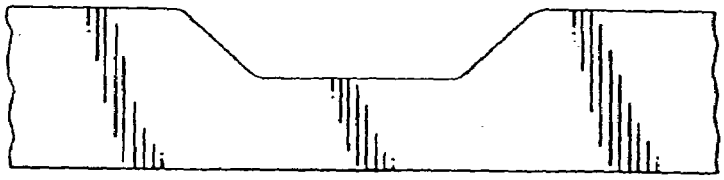
FIG. 8A is a schematic view of an embodiment of a recess that may be defined in the guide tracks which is used in connection with the door assembly of the present invention.
Figure 8B:
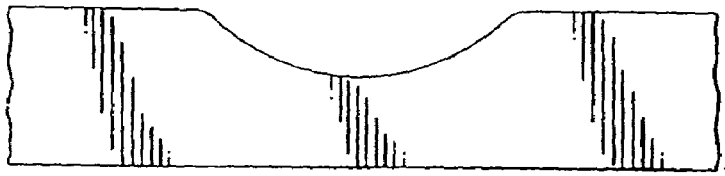
FIG. 8B is a schematic view of a second embodiment of a recess that may be defined in the guide tracks which is used in connection with the door assembly of the present invention.
Figure 8C:
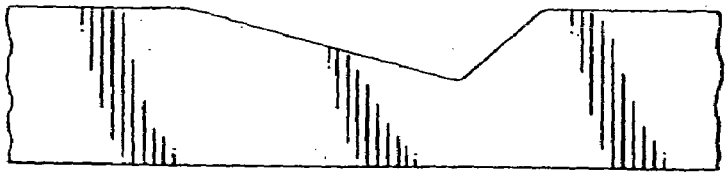
FIG. 8C is a schematic view of a third embodiment of a recess that may be defined in the guide tracks which is used in connection with the door assembly of the present invention.
Figure 8D:
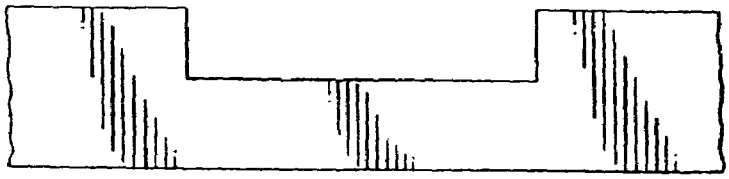
FIG. 8D is a schematic view of a fourth embodiment of a recess that may be defined in the guide tracks which is used in connection with the door assembly of the present invention.
Figure 8E:
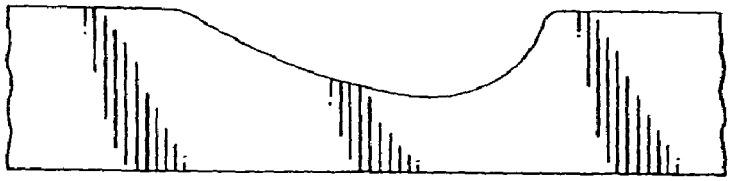
FIG. 8E is a schematic view of a fifth embodiment of a recess that may be defined in the guide tracks which is used in connection with the door assembly of the present invention.

In one embodiment of the present invention shown in FIG. 7, the door system 10 includes a third guide track defining 34 a third linear guide path 36. According to this embodiment, the third guide track 34 is disposed between the top and the bottom of the opening. It is contemplated that the third guide track 34 may include the impact separation system described in U.S. patent application Ser. No. 10/320,323.

As discussed above, the first and second guide tracks 20,24 each include a first recess 28,28' and second recess 30,30' defined therein. It is important to note that the recesses 28,30,28'30' defined in the first and second guide tracks 20,24 are not intended to be limited to those that include a declining slanted surface. Instead, the recesses may be declivities or, without limitation, any interruption in the linear guide paths 22,26 defined by the guide tracks 20,24 without departing from the present invention, including those depicted in FIGS. 8A-8E. For example, according to one embodiment of the present invention, each of the recesses is defined by a downwardly canting surface which transitions to a substantially planar surface. Again, it is contemplated that any configuration be employed which is suitable for altering the relative plane of travel along the guide tracks 20,24.

Figure 9:
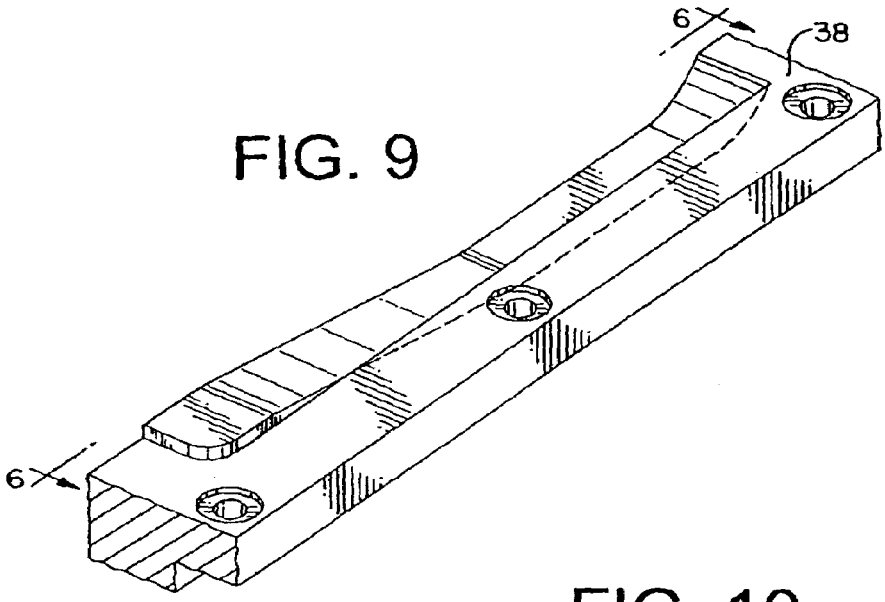
FIG. 9 is a perspective view of a drop block that may be used in connection with the door assembly of the present invention.
Figure 10:
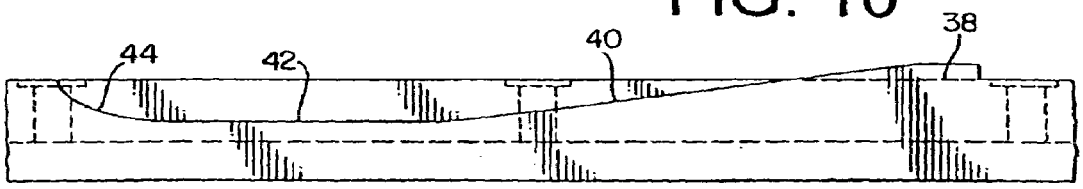
FIG. 10 is a side view of a drop block that may be used in connection with the door assembly of the present invention.
Figure 11:
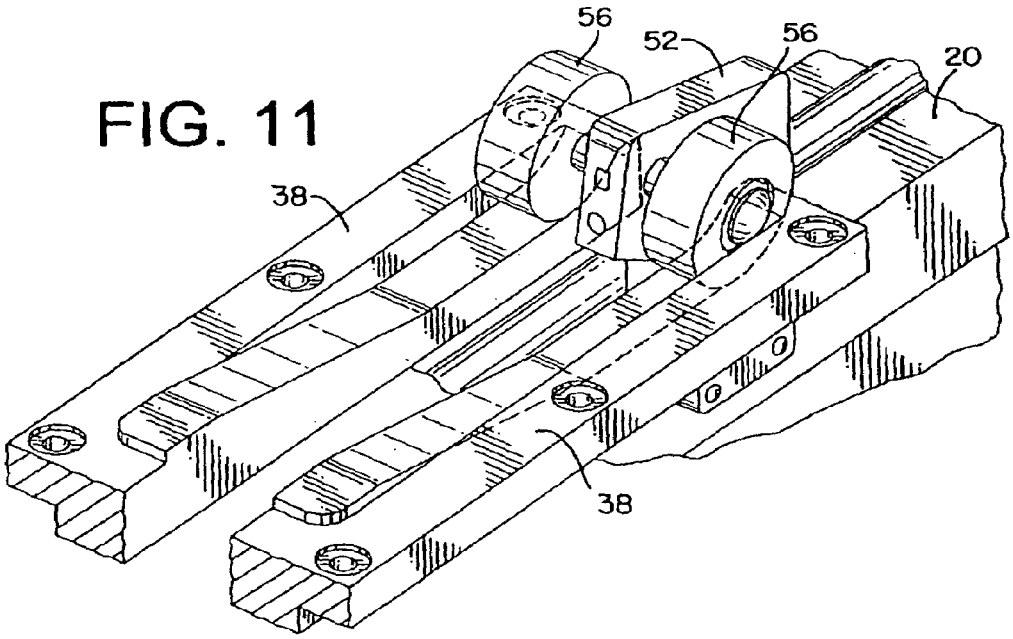
FIG. 11 is a perspective view of one embodiment of a trolley assembly and guide track according to the present invention; and, FIG. 12 is a perspective view of another embodiment of a trolley assembly and guide track according to the present invention.
Figure 12:
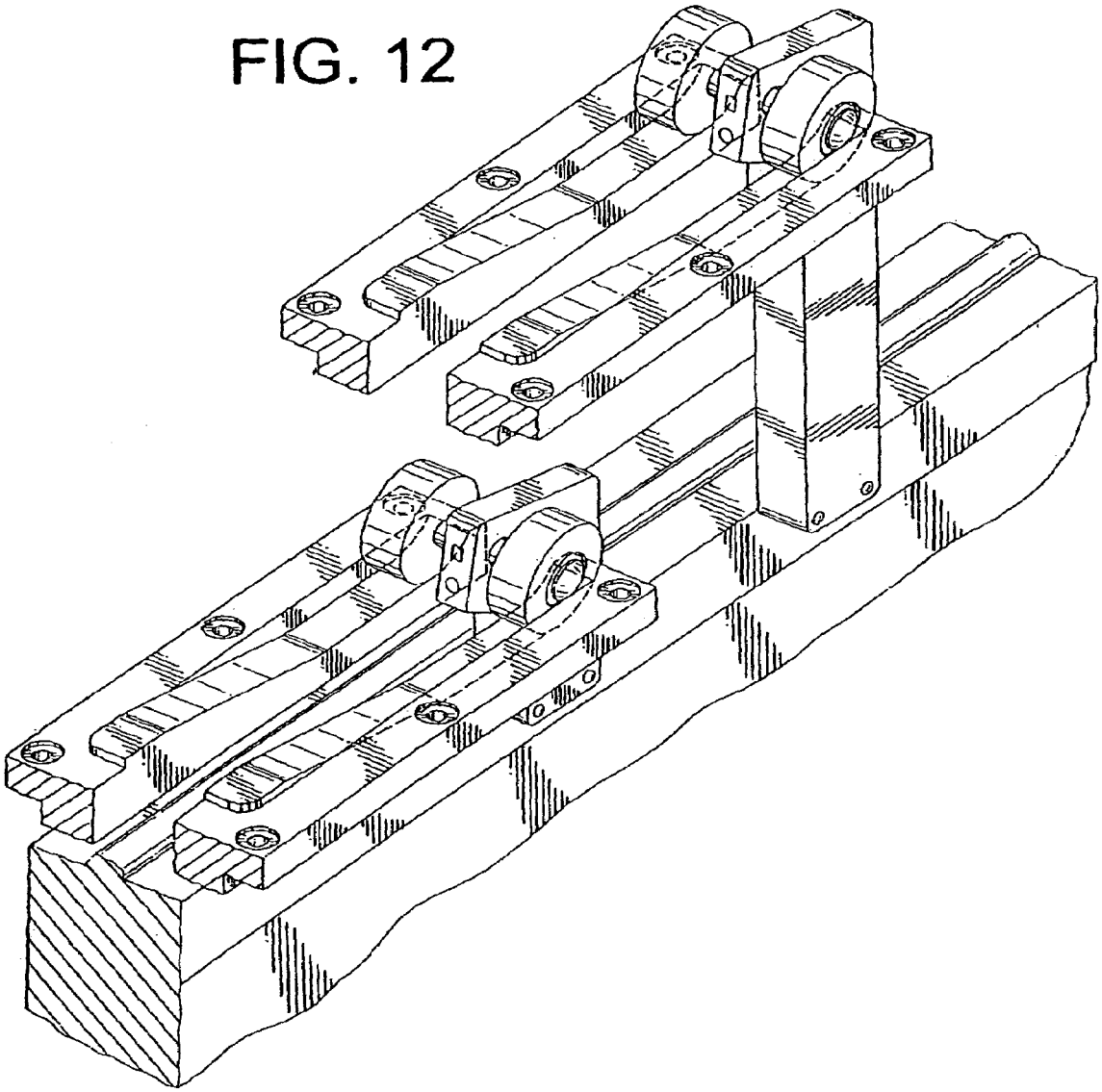

FIGS. 9-11 illustrate one embodiment of the invention in which the recesses 28,30,28',30' of both the first and second guide tracks 20,24 are defined by drop blocks 38 which are mounted to the respective the guide tracks 20,24 as may be seen in FIG. 10, each drop block 38 comprises a downwardly canting surface 40 which transitions to a substantially planar surface 42. The planar surface terminates in a upwardly canting surface 44. The drop blocks 38 may be made from a lower-friction material than that of the guide tracks. The drop blocks 38 may be manufactured using conventional methods, including extrusion, cast molding, or other forming methods generally known to those skilled in the art which are suitable for forming low friction materials. The drop blocks 38 may be mounted between separate guide tracks pieces using conventional fasteners or mounting mechanisms, such that a single guide track is formed by the connected members. Alternatively, the drop blocks 38 may be mounted within openings cut within a continuous guide track.

The first and second door panels 14,15 are attached to the guide tracks 20,24 by a trolley system. The trolley system comprises a first trolley 48 and a second trolley 50. Generally, the first and second trolleys include a first and second trolley mount 52, 54, respectively. Each roller mount 52,54 has at least one roller 56 attached thereto. The rollers 56 of the first roller mount 52 operably engage the first guide track 20, and the rollers 56 of the second roller mount 54 operably engage the second guide track 24. The first door panel 14 is attached to the first trolley 48 proximate the leading edge of the door panel 14 and first the door panel door panel 14 is attached to the second trolley proximate the trailing edge of the first door panel.

Similarly, the second door panel 15 is attached to a third trolley 48' and a fourth trolley 50'. The third and fourth trolleys 48',50' also each respectively comprise a first and second roller mount 52',54', wherein each roller mount 52',54' has at least one roller 56' attached thereto. The rollers 56' of the first roller mount 52' operably engage the first guide track 20, and the rollers 56' of the second roller mount 54' operably engage the second guide track 24. The second door panel 15 is attached to the third trolley 48' proximate the leading edge of the second door panel 15 and the second door panel 15 is attached to the fourth trolley 50' proximate the trailing edge of the second door panel 15.

In one embodiment of the present invention shown in FIG. 11, the first guide track 20' and the second guide track 24' are each parallel linear surfaces, and the first guide track 20 is disposed above the second guide track 24'. In this embodiment, rollers 56,56' are attached on opposing sides of each of the roller mounts 52, 54, 52',54', and the rollers 56,56' attached to the first roller mount 48 and third roller mount 48' operably engage the parallel linear surfaces of the first guide track 20'. The roller mounts of the second and fourth trolleys 50, 50' extend between the parallel linear surfaces of the first guide track 20' and the rollers 56,56' attached to the second and fourth roller mounts 54,54' operably engage the parallel linear surfaces of the second guide track 24'.

In operation, the trolleys 48,50,48',50' assist each door panel 14,15 to translate laterally to the closed position. As each door panel 10,15 translates laterally to the closed position, the rollers 56,56' of the respective roller mounts 52,54,52',54' engage the recesses 28,30,28',30' in the respective guide tracks 20,24. Generally, the rollers 56,56' which engage on the second guide track 24 engage the recesses therein at substantially the same time that the rollers 56,56' on the first guide track 20 engage the recesses of the first guide track 20. As the rollers 56,56' move down the respective recesses 28, 30, 28',30', the bottom edge of each of the door panels 14,15 to moves toward the bottom of the opening. Accordingly, when the door panels 14,15 are in an open position the bottom seals 32 are disengaged from the bottom of the opening. When the door panels 14,15 translates to the closed position the bottom seal 43 of each door panel 14,15 is in sealing engagement with the bottom of the opening.

While the specific embodiments have been illustrated and described, numerous modifications come to mind without significantly departing from the spirit of the invention and the scope of protection is only limited by the scope of the accompanying Claims.

What is claimed is:

1. A bi-parting sliding door for selectively opening and closing an opening, the opening being defined within a wall, the wall having a top portion and opposed side portions adjacent a floor, the door comprising:

a first guide track defining a first linear guide path, the first guide track being mounted proximate the top portion of the wall, the first guide track including a first recess and a second recess defined therein, the first and second recesses being linearly spaced on opposed sides of a midpoint of the first guide track;

a second guide track defining a second linear guide path, the second guide track being mounted proximate the top portion of the wall and spaced from the first guide track, the second guide track including a first recess and a second recess defined therein, the first and second recesses in the second guide track being linearly spaced from the midpoint of the first guide track and spaced outwardly from the midpoint more than the first and second recesses of the first guide track; and, a first door panel and a second door panel each having a top edge, a bottom edge, a leading edge and a trailing edge, the first and second door panels each being adapted to translate laterally relative to the opening between a closed position and an open position, a pair of first trolleys each being operatively attached to a first portion of a respective one of the first and second door panels and the first guide track and a pair of second trolleys each being operatively attached to a second portion of a respective one of the first and second door panels and the second guide track such that the pair of first trolleys only engage the first track and the pair of second trolleys only engage the second track.

2. The door of claim 1, wherein the first and second guide tracks are each made from a first material and the first and second recesses in each of the first and second guide tracks each include a material different than the first material.

3. The door of claim 2, wherein the different material is a lower-friction material than the first material.

4. The door of claim 1 wherein the first and second recesses of the first guide track and the first and second recesses of the second guide track each being defined by a drop block, each drop block comprising a downwardly canting surface that transitions to a substantially linear surface.

5. The door of claim 4, wherein the substantially linear surface of each drop block terminating in an upwardly canting surface.

6. The door of claim 1, wherein each of the pair of first trolleys comprising a first roller mount and each of the pair of second trolleys comprising a second roller mount, each of the roller mounts having at least one roller attached thereto, wherein each of the rollers of the pair of first trolleys operatively engages the first guide track, and each of the rollers of the pair of second trolleys operatively engages the second guide track; and, wherein the trolleys assist each door panel to translate laterally between the open position and the closed position, and the rollers substantially contemporaneously engage in the recesses in the respective guide tracks, causing said bottom edge of each of the panels to move toward the floor when said panels are in said closed position.

7. The door of claim 6, wherein the first guide track and the second guide track are each parallel linear surfaces.

8. The door of claim 7, wherein the first guide track is disposed above the second guide track.

9. The door of claim 7, wherein the rollers of the pair of first trolleys operatively engage the parallel linear surfaces of the first guide track, and wherein the rollers of the pair of second trolleys operatively engage the parallel linear surfaces of the second guide track.

10. The door of claim 1, wherein a material of the recesses is different from a material of the guide tracks.

11. The door of claim 10, wherein the material of the recesses being a lower-friction material than the material of the guide tracks.

12. The door of claim 1, further comprising a pair of bottom seals each disposed proximate the bottom edge of a respective one of the first and second door panels, wherein when the door panels are in the open position the bottom seal of each of the first and second door panels is disengaged from the floor and when the door panels translate to the closed position the bottom seal of each of the first and second door panels is in sealing engagement with the floor.

13. The door of claim 1, further comprising:

a motor being operatively coupled to a drive system, wherein the drive system and the motor move the first and second door panels between the open and closed positions; and, a controller in electronic communication with the motor, the controller for controlling a starting, a stopping, a speed and a direction of the motor.

14. The door of claim 1, wherein the first guide track and the second guide track are plates.

15. The door of claim 1, wherein the first guide track and the second guide track are rods.

16. The door of claim 1, further comprising a third guide track defining a third linear guide path, wherein the third guide track is disposed between the top portion of the wall and the floor.

17. The door of claim 1, wherein the first and second guide tracks are canted downward toward an apex proximate the midpoint of the opening.

* * * * *